United States Patent [19]

DeLarocha

[11] Patent Number: 5,015,110

[45] Date of Patent: May 14, 1991

[54] APPLICATOR ASSEMBLY FOR A LIPSTICK OR LIKE SUBSTANCE

[76] Inventor: Daniel D. DeLarocha, 5376 W. 14th La., Hialeah, Fla. 33012

[21] Appl. No.: 432,857

[22] Filed: Nov. 7, 1989

[51] Int. Cl.[5] ..... A45D 40/00; A45D 40/10; A45D 40/18

[52] U.S. Cl. ..... 401/10; 118/76; 118/226; 132/293; 132/297; 132/317; 401/52; 401/119; 401/191

[58] Field of Search ..... 132/293, 294, 295, 297, 132/303, 314, 317, 318; 401/9, 10, 52, 119, 125, 191, 10; 118/76, 226, 255

[56] References Cited

U.S. PATENT DOCUMENTS

| | | | |
|---|---|---|---|
| 1,686,200 | 10/1928 | Cannard et al. | 132/295 |
| 1,988,305 | 1/1935 | Dunn et al. | 118/226 |
| 2,175,133 | 10/1939 | Singleton | 132/317 |
| 2,338,195 | 1/1944 | Mills et al. | 118/226 |
| 2,517,089 | 8/1950 | Dean | 401/10 |
| 3,564,636 | 2/1971 | Tomer | 401/10 X |

FOREIGN PATENT DOCUMENTS

| | | | |
|---|---|---|---|
| 424115 | 2/1935 | United Kingdom | 118/76 |

*Primary Examiner*—Steven A. Bratlie

*Attorney, Agent, or Firm*—Malloy, Downey & Malloy

[57] ABSTRACT

An applicator assembly for supplying lipstick or like substance to the lips of the user by first coating opposite surfaces of an applicator sheet with the substance to be applied and then applying the coated applicator sheet to the mouth of the user. The assembly comprises a housing having substance supply containers movable into and out of opposite surfaces of individual applicator sheets entering the housing in an operative position and further wherein a supply of such applicator sheets may be considered a part of the housing.

13 Claims, 2 Drawing Sheets

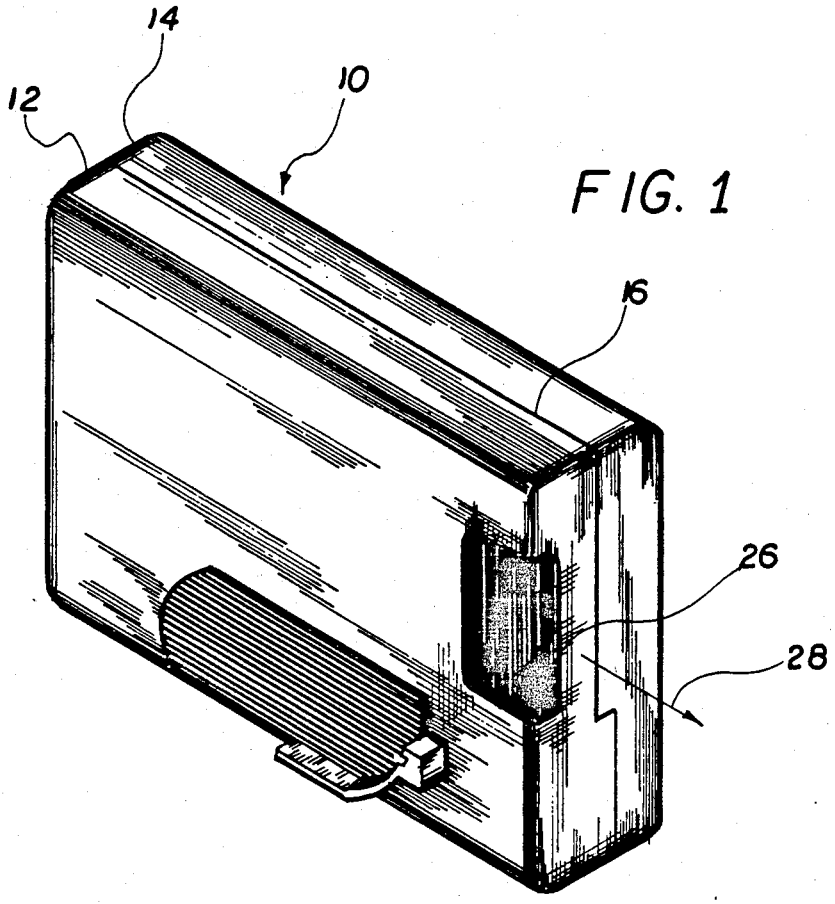
FIG. 1
FIG. 2
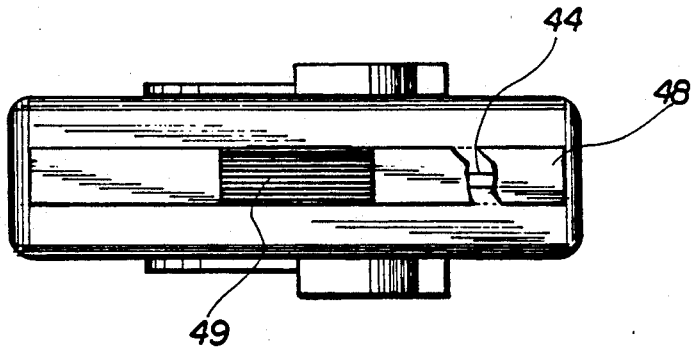
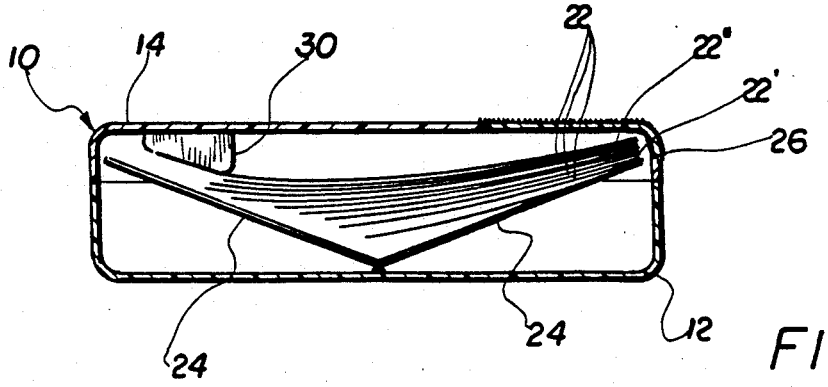
FIG 3

FIG. 4
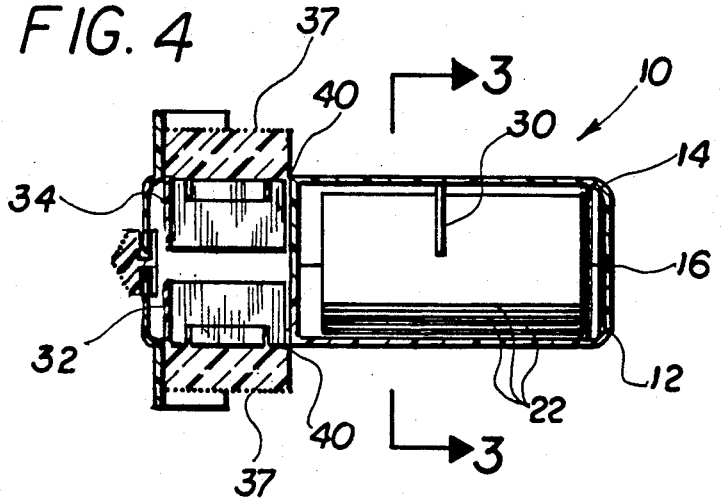
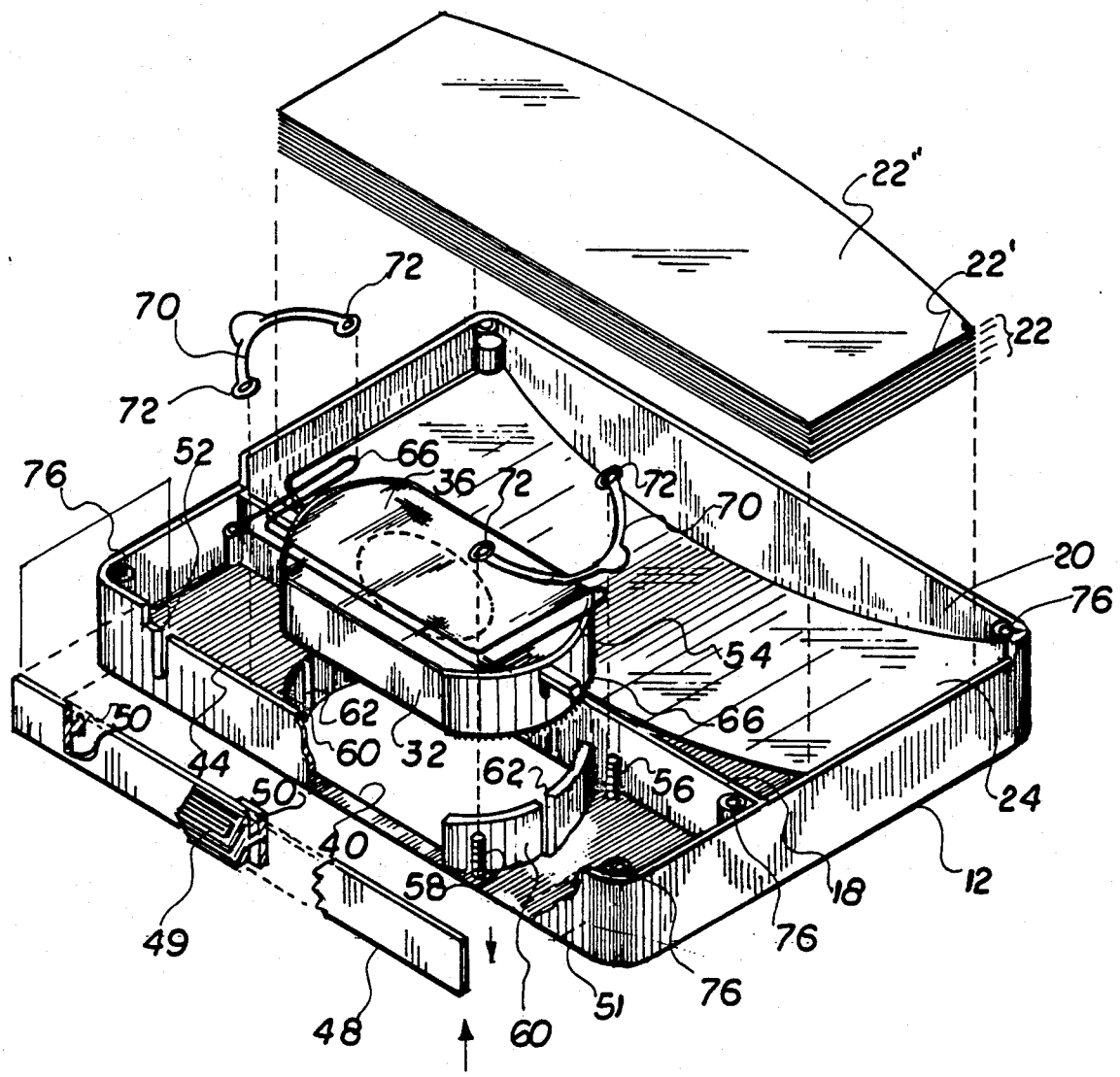
FIG. 5

APPLICATOR ASSEMBLY FOR A LIPSTICK OR LIKE SUBSTANCE

BACKGROUND OF THE INVENTION

1. Field of the Invention

This invention relates to an assembly designed to apply a substance coating such as but not limited to lipstick to the lips or applicable portions of the user's body by first coating individual applicator sheets and then transferring the coated sheets to the lips for transfer of the substance thereto.

2. Description of the Prior Art

In the application of lipstick or any like material to the lips of the user's body, it is most common to utilize a "stick" of such substance normally housed in an elongated tube wherein the applicator end of such substance stick may be adjusted inwardly or outwardly of the two depending upon the amount of material previously utilized. There are, of course, other structures and methods for applying lipstick such as brushes wherein the lipstick is effectively painted on the lips from a separable supply or the like. In addition, other structures and methods of application include templates and other type applicators designed to apply a lipstick type substance or material to the lips in a more effective manner.

Representative of such prior art methods, structures, assemblies, etc. include the following U.S. Patents.

U.S. Pat. No. 203,917 discloses a combined lipstick holder and lip rouge applicator. Milton et al. also discloses an alternate design of a lip rouge applicator in U.S. Pat. No. 201,168.

The Smith U.S. Pat. No. 3,177,879, is directed to a cosmetic device for the application of rouge to the lips using an applicator which facilitates the application emphasizing a delineated outline hopefully rendering the appearance of the user more attractive. The Smith device comprises a head member having upper and lower peripheral edges of contours corresponding respectively to the longitudinally contracted upper and lower outlines of the sections of the lips. The head member is substantially flat and terminates in a pointed tip and includes front and rear convex faces with borders tapering to relatively sharp upper and lower edges corresponding to the contracted outline of a symmetrical half of the lips.

The Girbert U.S. Pat. No. 2,248,533, discloses a mouth beautifier comprising a device having a concave, partly cylindrical surface and an outline of the combined lip shape of the upper and lower lips. Rouge is applied to the surfaces and spread so that the device may then be pressed against the closed mouth to apply the lip rouge to the lips in accordance with the shape of the aforementioned surfaces.

While it is assumed that the structures of the types disclosed above are operable for their intended function, it is obvious that there still exists a need for a more efficient applicator assembly and/or structure for applying lipstick or any other substance to the lips of the user in a more efficient manner and in a manner which quickly adds to the overall aesthetic appearance of such application.

SUMMARY OF THE INVENTION

The present invention relates to an applicator assembly of the type specifically designed to apply a coating substance to the lips of a user in a precise and efficient manner. Such substance clearly could be lip rouge but the subject applicator assembly is adapted for the coating type application of any number of substances which may be cosmetic or medicinal. The subject applicator assembly includes a housing having two substantially opposed substance supply containers movably mounted on the interior of the housing but accessible from the exterior thereof through openings formed in the housing. The openings are disposed and dimensioned to allow fingers of the user to physically push or inwardly direct the supply containers towards one another. Further, the supply containers are movable relative to an adjacently positioned access opening also formed within the housing. The access opening is dimensioned and configured to allow passage therethrough of an applicator sheet. The relative disposition of the supply containers and access opening is such that the once the applicator sheet is passed into the interior of the housing through the access opening, the supply containers can be moved, by the fingers of the user, towards one another and into substance transferring engagement with opposite surfaces of the applicator sheet. Once this occurs, the applicator sheet is removed from the housing, again through the access opening, and applied to the lips of the user. The substance originally placed on opposite surfaces of the applicator sheet is, of course, then transferred to the lips of the user. After use, the sheet may then be discarded.

Another feature associated with the subject applicator assembly comprises a sheet supply container or chamber also located on the interior of the housing. A biasing means is disposed in cooperative relation within the chamber and in biasing engagement with a plurality or "supply" of sheets. The relative dimension of the sheets and the disposition of the biasing means is such as to position one end of the sheets, consecutively, into accessible relation to an opening or aperture formed in the exterior wall of the housing through which the sheets may be removed for individual use.

It should be apparent, therefore, that use of the applicator assembly in the manner described above and more fully described hereinafter allows for an efficient means of applying a coating substance to the lips of the user thereby eliminating any disadvantages associated with prior art devices such as common lipstick type structures.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the housing of the present invention.

FIG. 2 is an end view of the embodiment of FIG. 1.

FIG. 3 is a sectional view showing interior structural features of a supply chamber associated with the subject invention.

FIG. 4 is a transverse sectional view showing various operative components mounted on the interior of the housing.

FIG. 5 is a perspective view in partially exploded form showing interior structural features of the housing and representing a partial segment thereof.

Like reference numerals refer to like parts throughout the several views of the drawings.

DETAILED DESCRIPTION OF THE PREFERRED EMBODIMENT

As shown in FIGS. 1 through 5, the present invention relates to an applicator assembly for applying a substance such as but not limited to a lip rouge to the lips of the user. As set forth above, other substances are clearly adaptable for use with the subject applicator assembly and such other substance may be medicinal, therapeutic, cosmetic, etc.

FIGS. 1 through 3 show the applicator assembly comprising a housing 10 primarily defined by two separable segments 12 and 14 joined about the periphery thereof at a common junction line 16.

FIGS. 4 and 5 disclose the internal working components of the housing. More specifically, the housing includes a hollow interior preferably segregated into compartments by a partition member or the like as at 18. In a preferred embodiment, the housing includes a chamber 20 specifically designed to hold a plurality of applicator sheets 22 such that through the provision of a biasing means or spring structure 24, the individual applicator sheets are accessible from the exterior of the housing 10 through an opening 26. The fingers of the user grip an end most portion as at 22' of an upper most applicator sheet and withdraw the sheet, by pulling through the opening 26 generally in the end of the wall of one of the segments 12 of the housing as indicated by directional arrow 28 (see FIG. 1). The biasing spring 24 (see FIGS. 3 and 5) is normally disposed on the interior of the supply chamber 20 and serves to support as well as bias and therefore position the individual sheets 22 in an operative and accessible position as clearly shown in FIG. 3. In such operative position, the one end adjacent the opening 26 is readily accessible to the fingers of the user and the top most sheet as at 22" has its longitudinal end 22' accessible through the opening 26. A stop or guide member 30 is secured to the opposite segment 14 on the interior thereof and serves to effectively guide and/or removably retain the plurality of applicator sheets 22 when in their stacked array so as to maintain the opposite ends as at 22' in the accessible position relative to the opening 26.

The subject applicator assembly further comprises a substance supply means defined by at least one but preferably two supply containers 32 and 34 designed to hold a coating substance, such as lipstick or the like, on the interior thereof and indicated in FIG. 5 as 36. Also shown in FIG. 5, the containers 32 and 34 each have an open inner face or mouth which serves to expose the coating substance 36 mounted on the interior of the containers 32 and 34. The opposite or outer end of each of the containers 32 and 34 is defined by a closed end or stopper member as at 37. Each of the closed outer ends 37 are accessible from the exterior of the housing through a positioning means defined by an apertured construction or more specifically, two positioning apertures 40 formed in each one of the segments 12 and 14. With regard to FIG. 5, the components shown therein are essentially the same as the operative or structural components mounted within the segment 14 of the housing 10. For purposes of clarity, however, the components and more particularly, the supply means including the supply containers 32 and 34 will be described only with regard to the half segment 12 as demonstrated in FIG. 5.

Mounting means are provided to movably mount the supply containers 32 and 34 on the interior of the housing such that inwardly directed force or pressure on the closed outer ends 37 of each of the supply containers 32 and 34 will force the supply containers towards one another and more specifically, towards one applicator sheet positioned between the containers 32 and 34 through an elongated access opening or slot 44 formed in a front longitudinal face of the housing (see FIGS. 2, 4 and 5). More specifically, once the upper most applicator sheet 22" is removed from the supply chamber 20 through opening 26, it is then passed, longitudinally through the access opening 44 having a sufficient longitudinal dimension, into an operative position. The operative position is defined by the applicator sheet passing into the interior of the housing between the supply containers 32 and 34 and more specifically, in a position which is accessible by the open mouths or faces of each of the supply containers 32 and 34 and the coating substance 36 therein. The inward forcing or direction of the supply containers 32 and 34 by the user pushing, by means of his fingers, inwardly on the closed ends 37 of each of the supply containers forces the substance 36 into transferring engagement with opposite surfaces of an applicator sheet positioned between the supply containers 32 and 34. Once the substance engages the opposite surfaces of the operatively positioned applicator sheet 22, the sheet 22 may be removed back through the access opening 44 and applied to the lips of the user. A cover member as at 48 may be movably mounted between a covering and non-covering relation to the access opening 44 as clearly shown in FIGS. 2, 4 and 5. The cover 48 includes a knob or like implement 49 to facilitate positioning of the cover 48 between the aforementioned covering and non-covering positions. Outwardly extending fingers 50 are secured to the inner surface of the cover 48 and are movably mounted within slots formed in the face 51 adjacent the access opening 44. The slots 52 are dimensioned and configured to allow sliding engagement of the fingers therein while the enlarged heads on the outer ends of the fingers 50 will prevent inadvertent removal of the cover 48 from its intended position.

An important feature of the present invention is the mounting means for allowing movement and selective positioning of each of the containers 32 and 34 into substance transferring engagement with opposite surfaces of the applicator sheet 22 disposed between the supply containers. Such mounting means is defined preferably by a biasing structure including a elongated elastic element such as but not limited to a rubber band type structure 54 mounted on upwardly extending retaining posts 56 and 58 formed on each end of the opening 40 behind the flanges 60 mounted adjacent such opposite longitudinal ends. Each of the flanges include an elongated opening as at 62 through which a projecting finger extending outwardly from opposite ends of each of the containers 32 and 34 as at 66 is received. The biasing band 54 overlies the projecting finger 66 and in effect, circles the outer portions of the opening 40 through its engagement with the two pairs of retaining posts 56 and 58 located on opposite ends of the opening 40. The opposite pair of retaining posts 56 and 58 are not clearly shown in FIG. 5 but it is emphasized that such exists for the disposition of the biasing band 54 in retaining engagement with the finger 66. In order to maintain the biasing member or elastic band 54 in its operative position, two retaining members 70 have an elongated configuration and oppositely disposed apertured ends 72 for engagement over the correspondingly positioned posts 56 and 58 and in overlying retaining engagement to the flexible material band 54. The band can serve to normally bias each of the supply containers 32 and 34 away from confronting engagement with opposite surfaces of an applicator sheet positioned on the interior of the housing. However, due to the flexibility of the band 54, finger pressure can position such supply containers 32 and 34 against the biasing force of the band 54 and into such confronting engagement for substance transfer to opposite surfaces of an operatively positioned applicator sheet 22.

Receiving guides or channels 76 are disposed to receive conventional connector type elements and/or projecting fingers so that the two segments 12 and 14 may be removably secured together in conventional fashion. However, separation of the segments to a certain extent must be facilitated to replenish the supply of applicator sheets 22 within the supply chamber 20.

Now that the invention has been described, what is claimed is:

1. An application assembly for coating lipstick or a like substance on an applicator sheet for the transfer of the substance to the lips of the user, said assembly comprising:

a housing including an access opening formed in a wall thereof, said access opening dimensioned to pass an applicator sheet therethrough, a substance supply movably mounted within said housing adjacent said access opening and including at least one supply container containing the substance therein and having an open, inner face exposing the contained substance and being selectively positionable into and out of substance transferring contact with a surface portion of the applicator sheet disposed within said housing through said access opening, mounting means movably securing said substance supply within said housing in normally spaced relation to said access opening in engageable relation to an applicator sheet and including biasing means interconnecting said supply container to said housing and structured for normally biasing said substance supply out of said substance transferring contact with the surface portion of the applicator sheet, and positioning means formed on said housing for positioning said substance supply into substance transferring contact with the applicator sheet and including an apertured construction formed in said housing being disposed and dimensioned to allow a finger of a user to pass therethrough into engaging relation with the supply container so as to facilitate movement of the substance supply into said substance transferring contact with the applicator sheet.

2. An assembly as in claim 1, wherein said housing further comprises a supply chamber formed therein and dimensioned and configured to contain a plurality of applicator sheets in an individually accessible location.

3. An assembly as in claim 2 further comprising a sheet biasing means mounted within said housing in biasing engagement with a plurality of sheets and structured for individual disposition of the sheets for removal from said housing.

4. An assembly as in claim 1, wherein said mounting means is structured for forced positioning of said substance supply by the finger into engagement with the applicator sheet within said housing.

5. An assembly as in claim 1 wherein said supply biasing means comprises an elongated elastic member interconnecting said substance supply to said housing in accessible relation to said positioning means and in biased, normally spaced relation from an applicator sheet within said housing.

6. An assembly as in claim 1, wherein said substance supply comprises two supply containers movably mounted within said housing on opposite sides of said access opening and each of said containers including an open, inner face disposed to transfer substance onto an opposite surface of an access sheet passing into said housing through said access opening.

7. An assembly as in claim 6 wherein each of said applicator sheets are formed of a substantially flexible material and dimensioned and configured to concurrently contact and transfer the substance thereon to the lips of the user.

8. An assembly as in claim 7 wherein said applicator sheets are formed and designed to apply said substance to both upper and lower lips of a user simultaneously.

9. An assembly as in claim 6 wherein said mounting means comprises a supply biasing means interconnecting each of said containers to said housing and structured for normally biasing said containers out of supply transferring engagement with one of the applicator sheets disposed within said housing.

10. An assembly as in claim 9 wherein said supply biasing means comprises an elongated elastic member interconnecting each of said supply containers to said housing in accessible relation to said positioning means and in biased, normally spaced relation from opposite surfaces of an applicator sheet within said housing.

11. Assembly as in claim 9 wherein said positioning means comprises an apertured construction including two apertures each formed in opposite walls of said housing and each disposed and dimensioned to allow a finger of a user to concurrently pass therethrough into engaging relation with each of the supply containers.

12. An assembly as in claim 11 wherein each of said supply containers comprise a closed inner face disposed in accessible relation relative to a corresponding one of said apertures, said supply containers and the open faces thereof concurrently positionable by the fingers of the user into substance transferring relation with an opposite surface of the sheet.

13. An assembly as in claim 1 further comprising cover means movably mounted on said housing for overlying and covering relation to said access opening and selectively positionable in spaced relation thereto.

* * * * *